US010240524B2

(12) United States Patent
Lucatello et al.

(10) Patent No.: US 10,240,524 B2
(45) Date of Patent: Mar. 26, 2019

(54) SYSTEM FOR VARIABLE ACTUATION OF A VALVE OF AN INTERNAL-COMBUSTION ENGINE

(71) Applicant: C.R.F. Societa Consortile per Azioni, Orbassano (Turin) (IT)

(72) Inventors: Marco Lucatello, Orbassano (IT); Francesco Vattaneo, Orbassano (IT); Vittorio Doria, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 19 days.

(21) Appl. No.: 15/353,068

(22) Filed: Nov. 16, 2016

(65) Prior Publication Data

US 2017/0184017 A1 Jun. 29, 2017

(30) Foreign Application Priority Data

Dec. 24, 2015 (EP) ..... 15202660

(51) Int. Cl.

| | |
|---|---|
| ***F01L 1/34*** | (2006.01) |
| ***F02B 69/06*** | (2006.01) |
| ***F01L 1/245*** | (2006.01) |
| ***F01L 9/02*** | (2006.01) |
| ***F02B 75/02*** | (2006.01) |

(52) U.S. Cl.

CPC ..... *F02B 69/06* (2013.01); *F01L 1/245* (2013.01); *F01L 9/02* (2013.01); *F01L 9/021* (2013.01); *F02B 75/02* (2013.01)

(58) Field of Classification Search

CPC ... F01L 1/245; F01L 9/021; F01L 9/02; F02B 69/06; F02B 75/02

See application file for complete search history.

(56) References Cited

U.S. PATENT DOCUMENTS

| | | | | |
|---|---|---|---|---|
| 4,664,070 | A | 5/1987 | Meistrick et al. | |
| 7,559,300 | B2 * | 7/2009 | Ruggiero | F01L 9/021 123/90.12 |
| 2004/0221820 | A1 * | 11/2004 | Opris | F02B 1/12 123/21 |

FOREIGN PATENT DOCUMENTS

| | | | |
|---|---|---|---|
| EP | 1726790 | A1 | 11/2006 |
| JP | S58152139 | A | 9/1983 |
| WO | 2015167412 | A1 | 11/2015 |

OTHER PUBLICATIONS

European Search Report dated Jun. 10, 2016, for European Application No. 15202660.5, 4 pages.

* cited by examiner

*Primary Examiner* — Zelalem Eshete
(74) *Attorney, Agent, or Firm* — RMCK Law Group, PLC

(57) ABSTRACT

Described herein is a system for variable actuation of an engine valve of an internal-combustion engine, where the system is able to actuate the engine valves, selectively, in a four-stroke operating mode and in a two-stroke operating mode, on the basis of the operating conditions of the engine.

7 Claims, 7 Drawing Sheets

SYSTEM FOR VARIABLE ACTUATION OF A VALVE OF AN INTERNAL-COMBUSTION ENGINE

CROSS REFERENCE TO RELATED APPLICATIONS

This application claims priority to European Patent Application No. 15202660.5 filed on Dec. 24, 2015, the entire disclosure of which is incorporated herein by reference.

FIELD OF THE INVENTION

The present invention relates to systems for variable actuation of engine valves for internal-combustion engines, of the type comprising:

- a hydraulic apparatus including:
- a master piston;
- a slave piston that can be driven by said master piston by means of a volume of fluid set between said master piston and said slave piston; and
- a solenoid valve configured for assuming a state in which said volume of fluid is set in communication with an outlet so as to render said slave piston independent from the movement of said master piston;
- a camshaft designed to drive said master piston in motion, which has a cam profile for governing, through said master piston, said engine valve in a four-stroke engine operating mode; and
- a control unit configured for controlling said solenoid valve so as to govern said engine valve, in said four-stroke engine operating mode, according to a lift and/or opening and closing times that are variable as a function of one or more parameters indicative of the operating conditions of the engine.

PRIOR ART

The present applicant has for some time been developing internal-combustion engines provided with a system for variable actuation of the engine intake valves, which has the characteristics referred to above and is marketed under the trademark "Multiair". The present applicant is the holder of numerous patents and patent applications regarding engines provided with a system of the type specified above and components of this system.

FIG. 1 of the annexed drawings shows an example of the system in question, which is used for actuation of two intake valves 7 of a cylinder of an internal-combustion engine. In the example illustrated, the system comprises a master piston 2 that is moved by a cam 4 and drives the respective slave pistons 6 of the two intake valves 7, for bringing the latter into the opening condition, by means of the volume of fluid V that sets itself between the slave pistons 6 and the master piston 2.

The solenoid valve 8 controls communication of the chambers of the hydraulic circuit within which the various pistons move with an outlet 12 connected to a fluid accumulator. When the solenoid valve is brought into the closed state B, the master piston 2 and the slave pistons 6 are rigidly connected in the transmission of the motion of opening and closing of the valves 7. When, instead, the solenoid valve is open, the chambers of the various pistons are in communication with the low pressure at the outlet 12, and the slave pistons 6 are hence rendered independent from the movement of the master piston 6. The solenoid valve 8 is normally in the open state, and goes into the closed state following upon electrical actuation of the valve itself.

In the system described, when the solenoid valve 8 is activated, i.e., it is brought into the closed state, the engine valve follows the movement of the cam (full lift). An anticipated closing of the engine valve can be obtained by opening the solenoid valve 8 so as to empty out the volume of pressurized fluid C and obtain closing of the valve 7 under the action of the respective return springs (not shown). Likewise, a delayed opening of the valve can be obtained by delaying closing of the solenoid valve, whereas the combination of a delayed opening and an anticipated closing of the valve can be obtained by closing and opening the solenoid valve during the thrust of the corresponding cam. According to an alternative strategy, in line with the teachings of the patent application No. EP1726790A1 filed in the name of the present applicant, each intake valve can be controlled in multilift mode, i.e., according to two or more repeated "subcycles" of opening and closing. In each subcycle, the intake valve opens and then closes completely.

In the light of what has been said above, the electronic control unit is consequently able to obtain a variation of the instant of opening and/or of the instant of closing and/or of the lift of the intake valve as a function of one or more operating parameters of the engine, such as the position of the accelerator pedal, the engine r.p.m., or the engine temperature (for example, the temperature of the oil or the temperature of the coolant). This enables an optimal engine efficiency to be obtained in every operating condition.

OBJECT AND SUMMARY OF THE INVENTION

The general object that the present applicant now pursues is to improve further the efficiency of the engine, in particular by providing a system for variable actuation of the valves that will enable one or more of the following advantages to be achieved:

- the possibility of running the engine in a wide range of values of compression ratio, in particular on high values of this ratio;
- an improvement of the consumption levels;
- the possibility of providing engines of small dimensions given the same power delivered;
- the reduction of the work of pumping performed by the pistons; and
- the possibility of providing lower compression ratios within the range of action of the turbosupercharger.

The object indicated above is achieved via a system for variable actuation of an engine valve of an internal-combustion engine, comprising the characteristics of claim 1.

The system described herein is characterized in that it is able to actuate the engine valves, selectively, in a four-stroke operating mode and in a two-stroke operating mode, on the basis of the operating conditions of the engine, in particular on the basis of the conditions of engine load.

The system described herein uses for this purpose the basic architecture of systems for variable actuation of the engine valves described above, but re-adapted and re-designed in an appropriate way. In particular, the system described herein presents, in general, the following characteristics:

- the camshaft or a further camshaft has a second cam profile for governing the engine valve in a two-stroke operating mode;
- the hydraulic system comprises a second master piston that can be actuated by the second cam profile and that is designed to drive the slave piston by means of a second volume of fluid set between the second master piston and the slave piston;

the solenoid valve is configured for assuming a state in which the second volume of fluid is set in communication with an outlet so as to render the slave piston independent from the movement of the second master piston; and the control unit is configured for controlling the solenoid valve so as to govern the engine valve, selectively, in one or other of the aforesaid two operating modes.

The present invention moreover regards a control method for a system for actuation of the engine valves of the type in question, as defined in Claim 7.

BRIEF DESCRIPTION OF THE DRAWINGS AND OF SOME EMBODIMENTS OF THE INVENTION

Further characteristics and advantages of the invention will emerge from the ensuing description with reference to the annexed drawings, which are provided purely by way of non-limiting example and in which.

Figure 1:
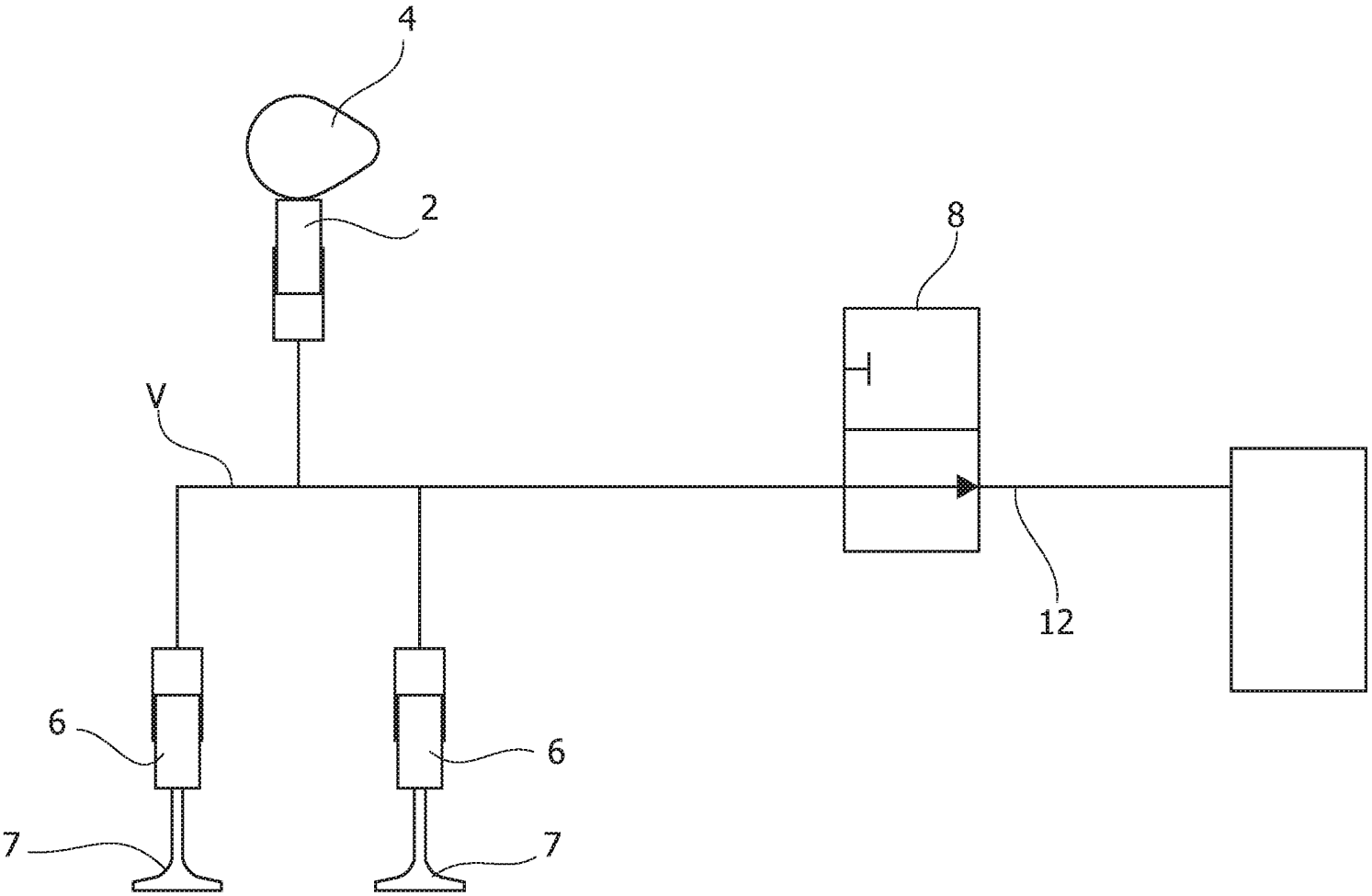
FIG. 1 is a diagram of a system for variable actuation of the valves of an internal-combustion engine, according to the known art.
Figure 2:
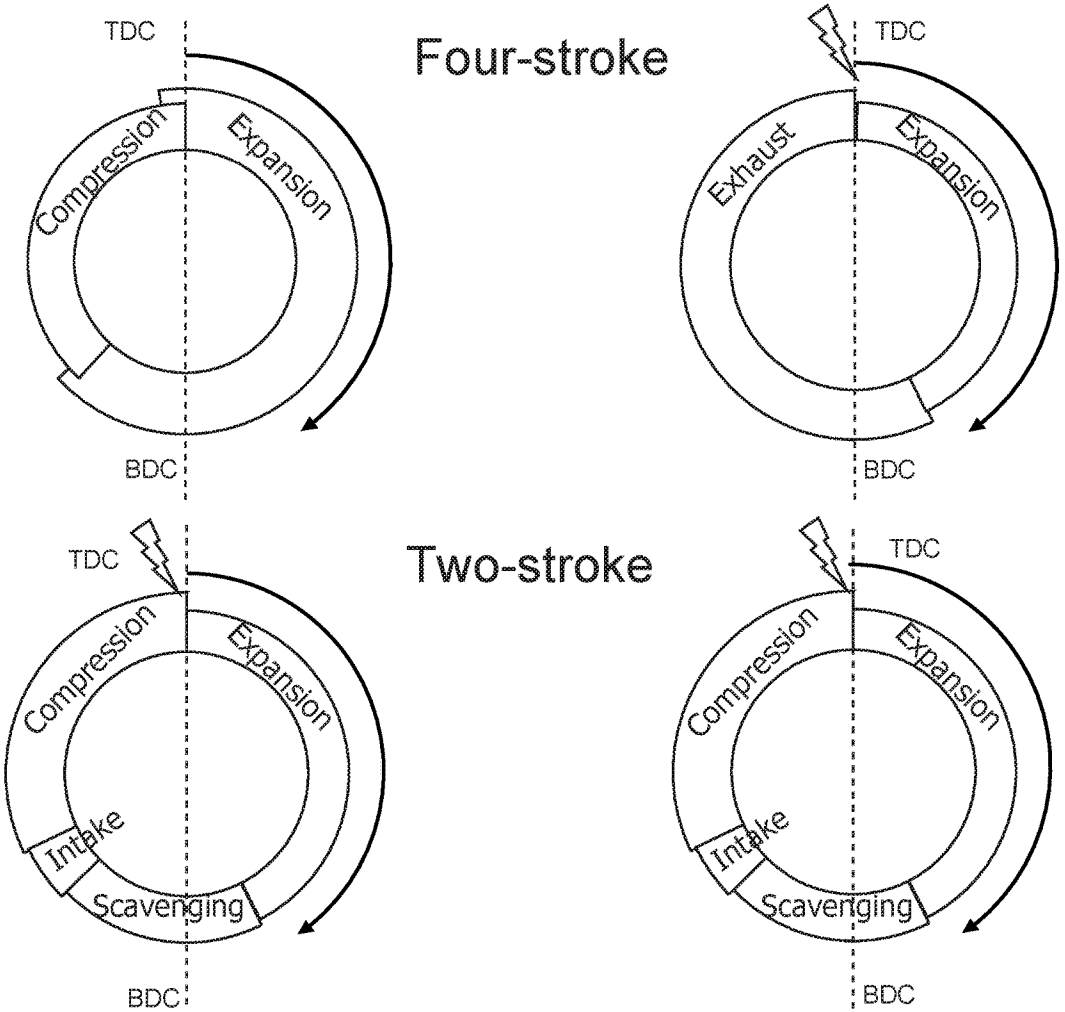
FIG. 2 is a schematic illustration of two examples, one regarding a four-stroke operating cycle and one regarding a two-stroke operating cycle of an internal-combustion engine.

In the ensuing description, various specific details are illustrated aimed at enabling an in-depth understanding of the embodiments. The embodiments may be provided without one or more of the specific details, or with other methods, components, or materials, etc. In other cases, structures, materials, or operations that are known are not shown or described in detail so that various aspects of the embodiment will not be obscured.

The references used herein are only provided for convenience and hence do not define the sphere of protection or the scope of the embodiments.

As is known, a typical four-stroke operating cycle of an internal-combustion engine comprises, in succession, an intake stroke, a compression stroke, an expansion stroke, and an exhaust stroke. The first two strokes, the intake and exhaust strokes, take place in a first crankshaft revolution, whereas the second two strokes, the expansion and exhaust strokes, take place in a subsequent crankshaft revolution. Usually, the intake stroke starts slightly before the end of the exhaust stroke of the previous cycle, when the piston has not yet reached top dead centre (TDC).

Also a two-stroke cycle envisages four strokes—intake, compression, expansion, and scavenging—, which, however, take place during one and the same crankshaft revolution. In this operating mode, exhaust of the burnt gases occurs in the so-called scavenging stroke and mainly occurs as a result of entry of the air-petrol mix into the combustion chamber, which thrusts the burnt gases out of the chamber.

Traditional two-stroke engines do not have the engine valves as a four-stroke engine but ports or slits made directly on the walls of the cylinder, which are opened and closed as a result of the reciprocating motion of the piston.

It should now be noted that in the framework of the technical field in question there have already been proposed four-stroke internal-combustion engines pre-arranged for operating also in the two-stroke mode. This is obtained by providing a set of further cams, specific for the two-stroke mode, and providing appropriate mechanical members designed to set in connection this set of cams with the intake and exhaust valves, and at the same time to disconnect from the latter the cams for the normal four-stroke mode.

In this connection, the document No. JPS58152139 describes a supercharged internal-combustion engine that is pre-arranged precisely with two different sets of cams for actuation of the engine valves, a first set for actuation of the valves in the two-stroke operating mode and a second set for actuation of the valves in the four-stroke operating mode. Selection of one or other of the two sets occurs via a system for positioning of the rockers associated to the valves, which is designed to displace the rockers between their condition of engagement with the cams of one set and their condition of engagement with the cams of the other set.

It should moreover be noted that the cams for a two-stroke cycle are configured in such a way that, in the scavenging stroke, the intake and exhaust valves are kept simultaneously in the open position so that the gases entering from the intake duct can thrust the burnt gases out of the combustion chamber. This action of scavenging of the chamber is on the other hand promoted by the supercharging pressure with which the air-petrol mix is supplied into the combustion chamber.

The advantages for an internal-combustion engine deriving from the possibility of operating also according to a two-stroke cycle principally regard the conditions of high load and lie in the fact that it is possible to exploit a number of combustion events of this cycle that is twice that of a four-stroke cycle in order to reduce the pressures involved that are set up within the combustion chamber. This offers to the designer of the engine the possibility of setting higher compression ratios without any risk of detonation, and, possibly, of reducing the overall dimensions of the engine given the same maximum torque delivered.

The system for variable actuation of the engine valves described herein is pre-arranged for providing the same possibility of passing from a four-stroke operating mode to a two-stroke operating mode, and vice versa, as the one envisaged by the solution of the document No. JPS58152139 discussed above.

As will be seen hereinafter, this result is, however, achieved without the use of mechanical devices for selection of the various cams of the two operating modes, as in the prior solution of the document No. JPS58152139.

Instead, the actuation system described herein uses a hydraulic apparatus similar to those used by the systems for variable actuation of the engine valves described at the start, which by itself is able both to govern the valves in the two operating modes, i.e., the two-stroke mode and the four-stroke mode, discussed above, and to provide a variable control of the valves as a function of the operating parameters of the engine, within one or both of the two modes in question.

Figure 3:
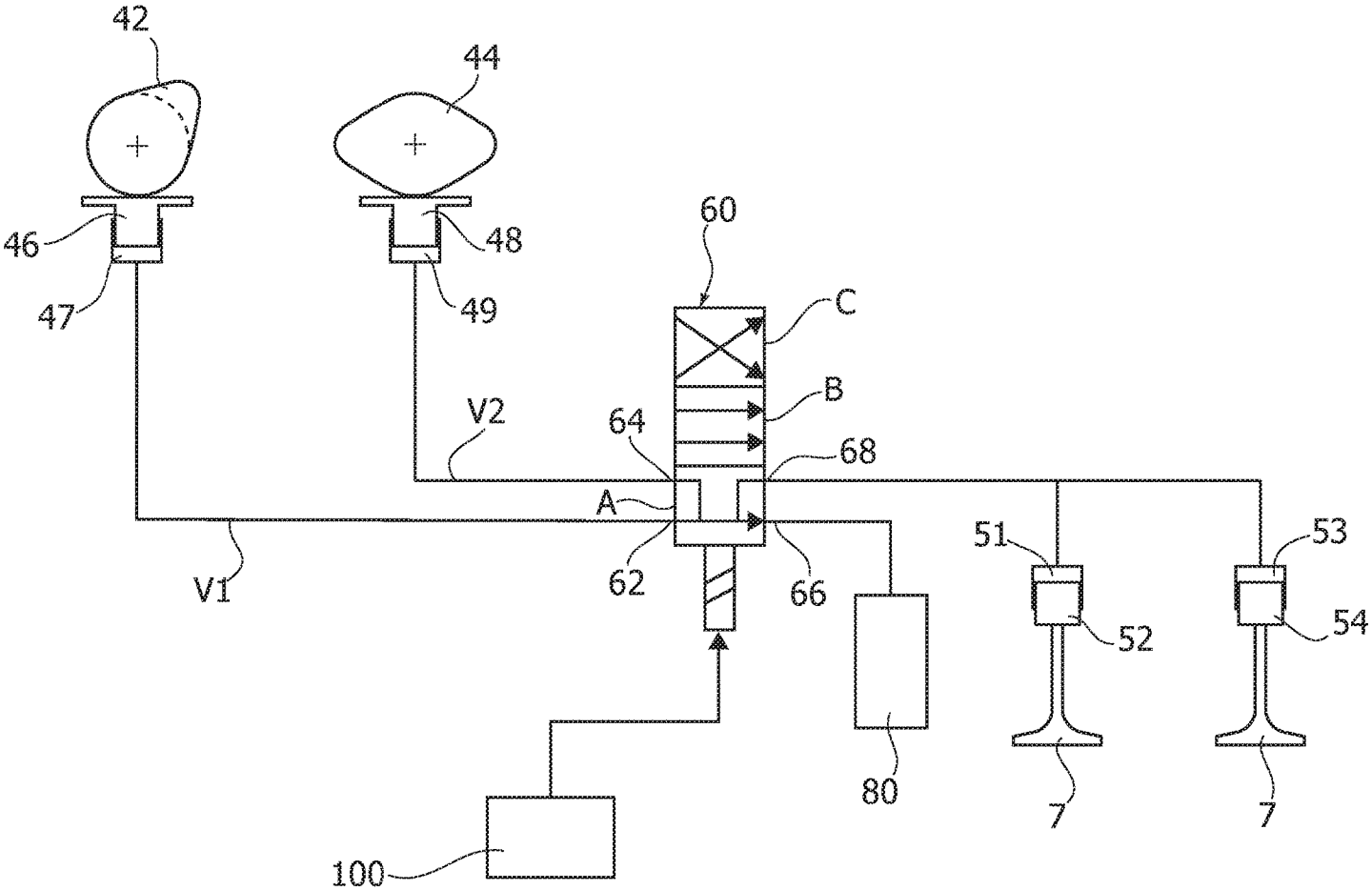
FIG. 3 is a diagram of a system for variable actuation of the valves of an internal-combustion engine, according to one embodiment of the invention.

FIG. 3 is a schematic illustration of an example of the actuation system described herein. In particular, the figure shows application of the system in question for actuation of two intake valves 7 of the cylinder of an internal-combustion engine.

The system comprises, in the first place, two different cams 42 and 44, the first for actuation of the valves according to a four-stroke operating mode and the second for actuation thereof according to a two-stroke operating mode. In the example illustrated, the two valves 7 are controlled via one and the same hydraulic apparatus that will be described in detail in what follows, and consequently the single cam is designed for actuating both of the two valves 7. However, this constitutes only an example of use of this type of apparatus, and in general the number of valves governed by each cam may vary according to the specific architecture of the engine. The two cams in question can be carried by one and the same camshaft or else by two different shafts according to the specific engine architecture.

The two cams 42 and 44 are designed to drive two respective master pistons 46, 48 of the aforementioned hydraulic apparatus, which are mobile within the chambers 47 and 49 defined by the hydraulic circuit of the apparatus in question. This circuit connects the chambers 47, 49 with the chambers 51, 53, mobile within which are, instead, the two slave pistons 52, 54, which are designed to drive the two valves 7 into the open condition.

A solenoid valve 60 is designed to control hydraulic connection between the chambers 47 and 49 of the master pistons and the chambers 51 and 53 of the slave pistons. In particular, the solenoid valve 60 comprises two inlets 62, 64, connected, respectively, to the chambers 47 and 49 of the master pistons, and two outlets 66, 68, the first of which is connected to a fluid accumulator 80, and the second to both of the chambers 51 and 53 of the slave pistons. Identified between the solenoid valve 60 and the chambers 47 and 49 are two distinct volumes of working fluid, the volume V1 acting on which is the master piston 46 and the volume V2 acting on which is the master piston 48.

The solenoid valve 60 has three different states that provide three different hydraulic connections, as explained hereinafter:

- a first state, designated by A in FIG. 3, in which the chambers 47, 49, 51, and 53, of the master pistons and of the slave pistons respectively, are all connected to the fluid accumulator 80;
- a second state, designated by B, in which the chamber 47 is connected to the accumulator 80, whereas the chamber 49 is connected to the chambers 51 and 53 of the slave pistons; and
- a third state, designated by C, in which the chamber 47 is connected to the two chambers 51 and 53 of the slave pistons, whereas the chamber 49 is connected to the fluid accumulator 80.

In the state A, where the chambers 47, 49, 51 and 53 are all connected to the fluid accumulator 80, the master pistons 46 and 48 and the slave pistons 52 and 54 are rendered independent from one another, in so far as the working fluid of the circuit displaced by the master pistons is free to move—with a flow in an amount corresponding to the volume of fluid displaced—into the fluid accumulator 80 without exerting any action on the slave pistons.

Consequently, in this state, the lift defined by the profiles of the two cams 42, 44 is not "perceived" by the two intake valves.

In the case where the state A is assumed by the solenoid valve 60 when the valves 7 are in the closed position, these will hence remain in this position notwithstanding the movement of the master pistons 46 and 48. In the case, instead, where the aforesaid state is assumed when the valves are in their open position, these will close under the thrust exerted by the respective return springs (not illustrated), and the slave pistons 51 and 53, which are mobile together with the valves, will, in turn, induce a flow of working fluid into the accumulator 80.

In the state B, the chamber 47 is likewise in communication with the outlet 66, and, hence, just as occurs in the state A described above, the movement of the piston 46, induced by the cam 42, is not perceived by the two slave pistons. Instead, in this state, the chamber 49 of the master piston 48 is set in communication with the chambers 51 and 53 of the slave pistons, and the volume of fluid displaced by the piston 48 is in this case prevented from exiting towards the accumulator 80 and acts on the slave pistons transmitting to the latter the movement of the master piston 48 governed by the cam 44.

In this state B, the two intake valves hence operate according to the two-stroke operating mode dictated by the profile of the cam 44.

In the state C, instead, it is the chamber 47 of the master piston 46 that is connected to the chambers of the two slave pistons, and it is hence the master piston 46, actuated by the cam 42, that induces a corresponding movement of the two slave pistons. The movement of the master piston 48 is not, instead, perceived by the two slave pistons. In this state, the two intake valves hence operate in the four-stroke engine operating mode dictated by the profile of the cam 42.

Figure 4A:
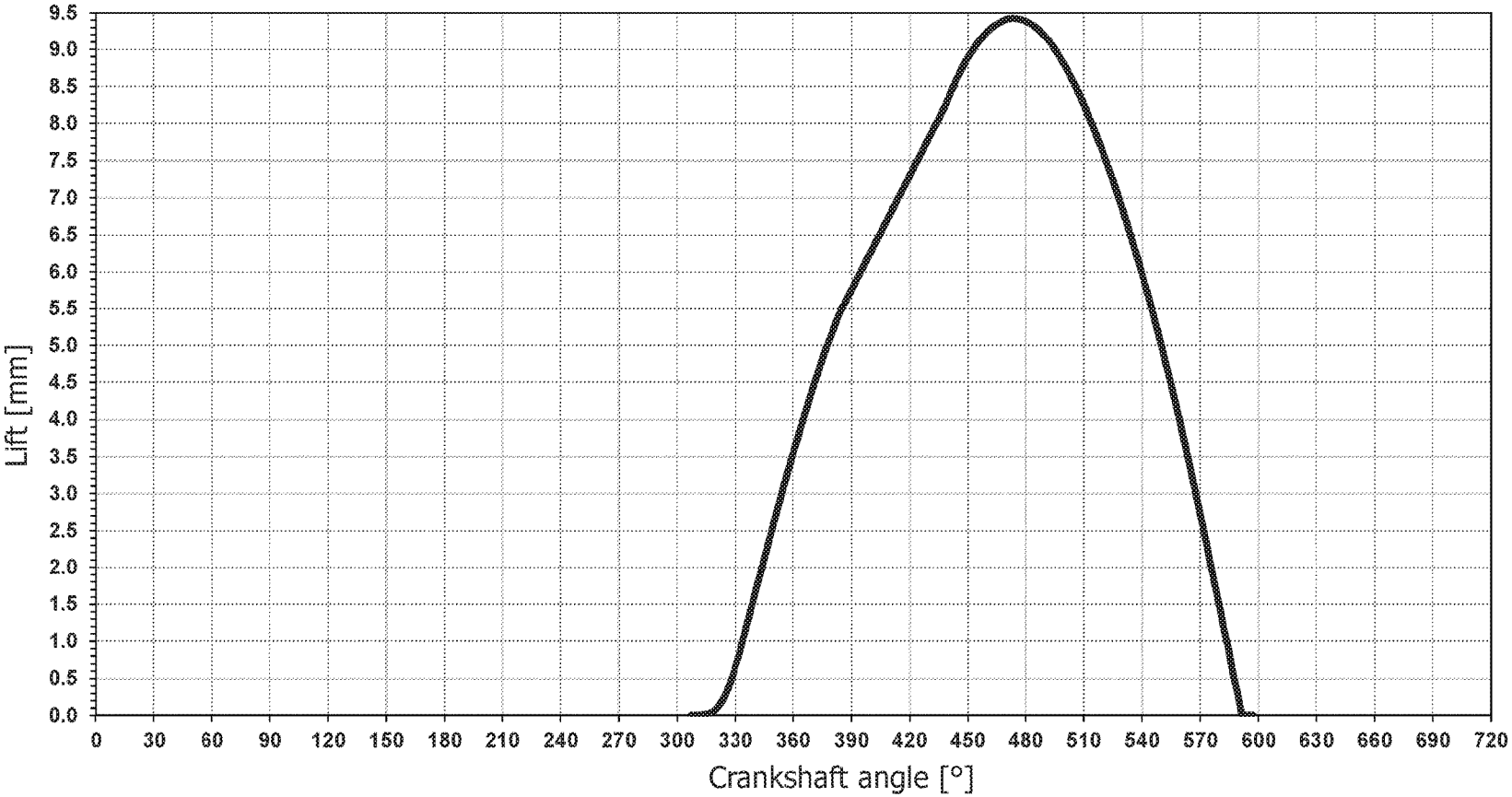
FIGS. 4A and 4B illustrate two different cam profiles for actuation of the intake valves of an engine for a four-stroke engine mode and for a two-stroke engine mode, respectively.
Figure 4B:
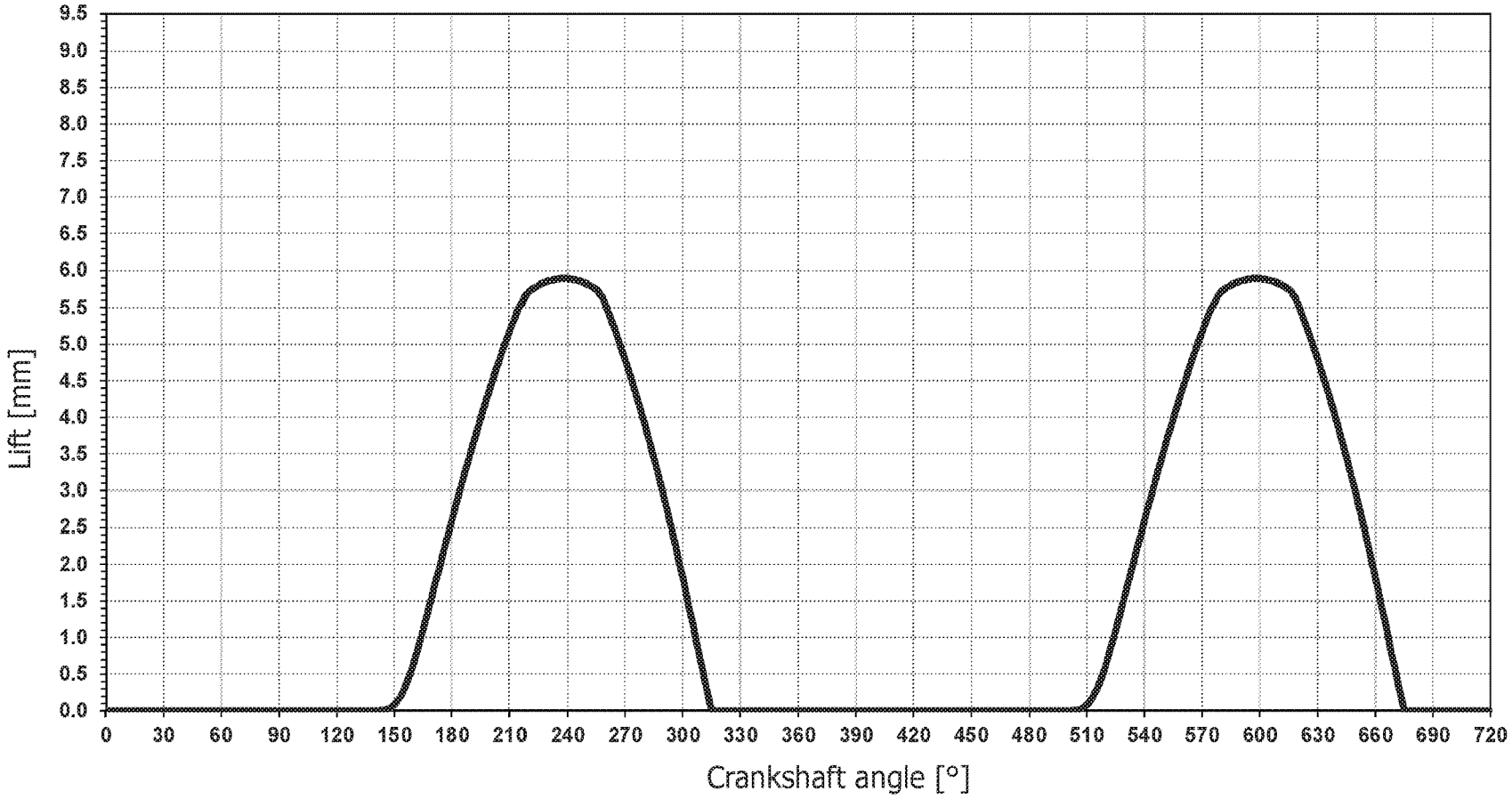

With reference now to FIGS. 4A and 4B, these illustrate, respectively, a cam profile for actuation of the engine valves according to a four-stroke engine operating mode and a cam profile for actuation of the engine valves according to a two-stroke engine operating mode. The profiles in question are each configured in an appropriate way for governing the valves in the corresponding engine operating mode. From the comparison of these figures, the differences between the two types of profiles are immediately evident. In the first place, the cam profile of the two-stroke mode presents two different lift curves, whereas the cam profile of the four-stroke mode presents just one. Moreover, the two peak values of the first mode are considerably lower than the single peak value of the second mode.

The system described herein further comprises a control unit, designated by the reference 100 in FIG. 3, which is configured for selecting the engine operating mode and for controlling the solenoid valve 60 on the basis of the mode selected and on the basis of the operating conditions of the engine.

The control unit is configured for selecting the engine operating mode on the basis of the engine load. In particular, the aforesaid unit is configured for selecting the two-stroke engine operating mode for engine loads above a given value and for selecting the four-stroke operating mode in the other conditions.

The parameter used by the system for measuring the engine load may, for example, be the position of the accelerator pedal, the pressure inside the intake or exhaust duct, the pressure inside the combustion chamber, etc.

In any case, the control unit has, stored therein, a reference value corresponding to the aforesaid given value of engine load, and is configured for selecting one or other of the two engine modes on the basis of the comparison between the measured parameter and the reference value.

As mentioned above, the system described herein is in any case also pre-arranged for governing a variable actuation of the engine valves as a function of the operating conditions of the engine, such as speed, load, temperature of the engine, etc., in a way similar to what occurs in the variable-valve-actuation (VVA) systems of the type described at the start with reference to FIG. 1.

This is obtained on the basis of the same principles used in the aforementioned known systems. In this connection, it should be noted, in fact, that by controlling the solenoid valve 60 between one or other of the states B and C described above, which correspond to an actuation of the valves according to the cam profile, and the state A of de-activation of the valves, it is possible to render, in the desired times and ways, the engine valves independent from the mechanical profile of the cam and hence obtain a variation of the instant of opening and/or of the instant of closing and/or of the lift of the valve. There may hence, for example, be envisaged control strategies characterized by late opening, early closing, a combination of late opening and early closing, or again the so-called multi-lift strategy mentioned above.

It should be noted, on the other hand, that, in the system described herein, the aforesaid variable control of the valves is based not only on the operating parameters of the engine referred to above, but also on the operating mode selected.

In the system described herein, it is hence possible to envisage various modes for control of the engine valves—for example, a conventional mode, a late-opening mode, an early-closing mode, a combined late-opening and early-closing mode, and a multi-lift mode—and to differentiate the control modes to be used between one engine operating mode and the other. By so doing, the operating efficiency of the engine is optimal for any condition.

Figure 5A:
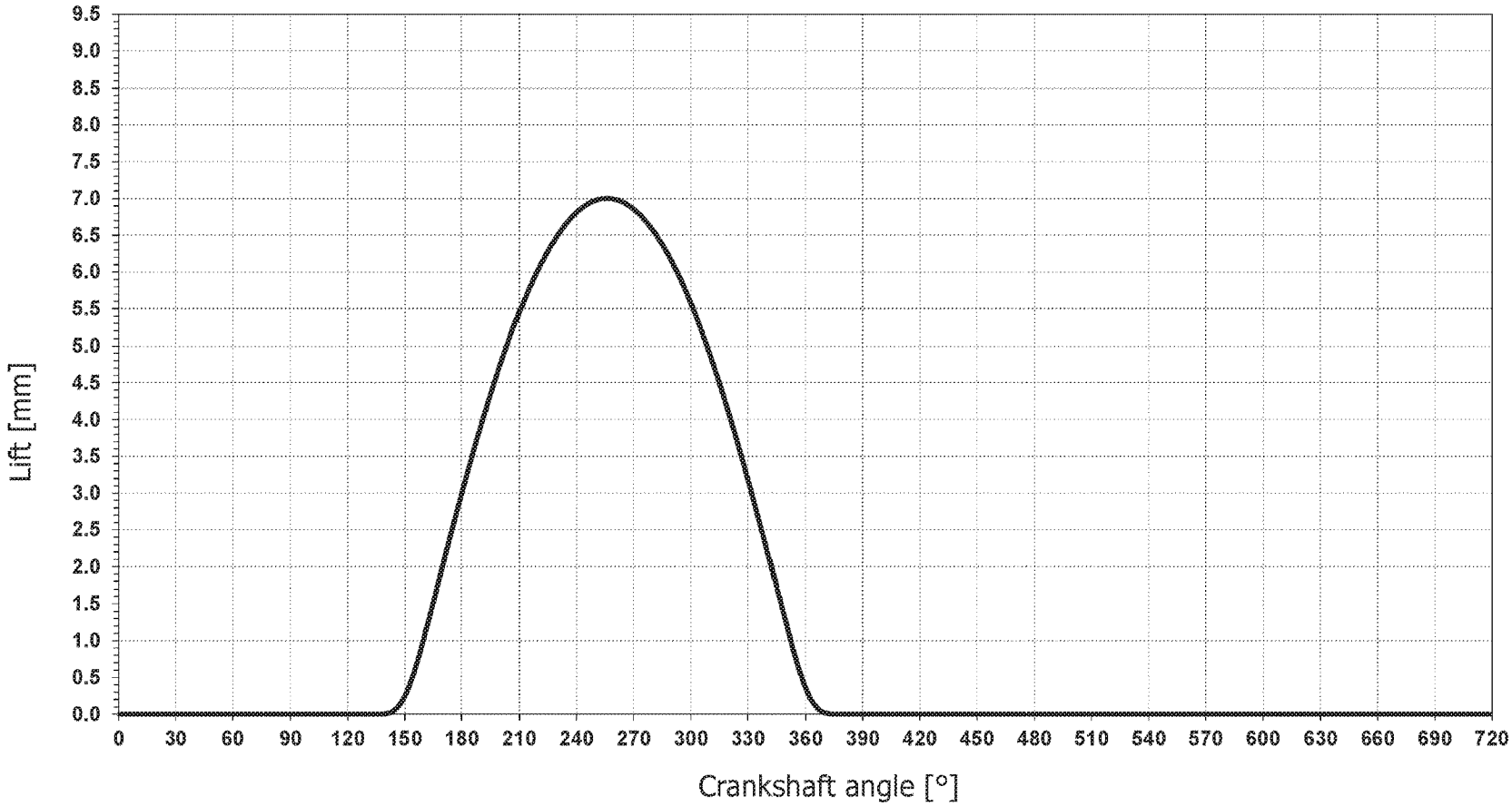
FIGS. 5A and 5B illustrate two different cam profiles for actuation of the exhaust valves of an engine for a four-stroke engine mode and for a two-stroke engine mode, respectively.
Figure 5B:
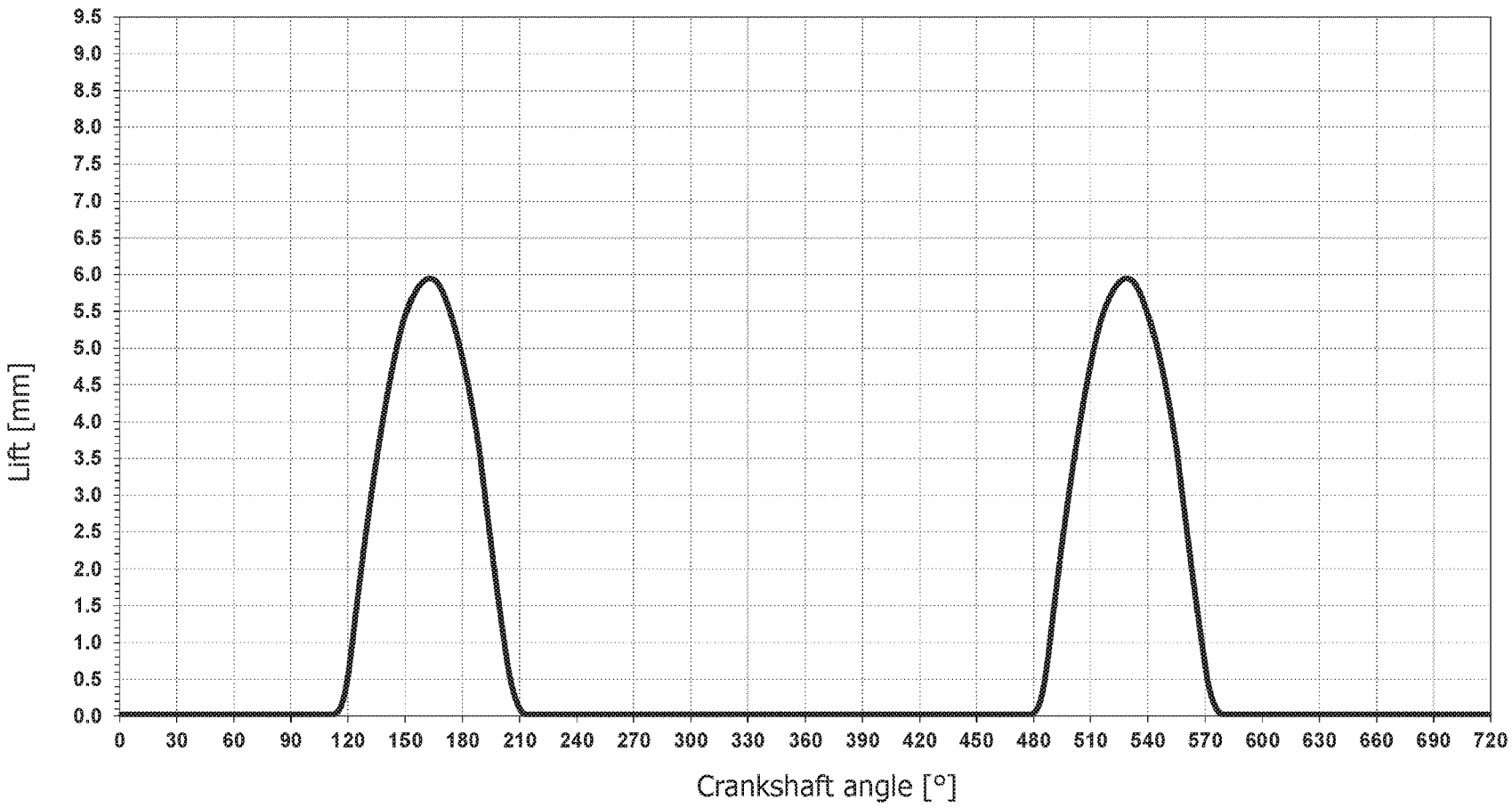

The above description refers to just the intake valves of the cylinder, but it is clear that the same architecture and the same procedure of control described above are applied also for actuation of the exhaust valves precisely in order to be able to control the engine in the two different operating cycles envisaged. In particular, the system will envisage also for the exhaust valves two different types of cam, and, in this regard, FIGS. 5A and 5B illustrate, by way of example, respectively, a first cam profile for actuation of the exhaust valves according to a four-stroke engine operating mode, and a second cam profile for actuation of the exhaust valves according to a two-stroke engine operating mode.

Of course, without prejudice to the principle of the invention, the embodiments and the details of construction may vary even significantly with respect to what is described and illustrated herein purely by way of example, without thereby departing from the scope of the present invention, as defined by the annexed claims.

Finally, it should noted that the valve 60 indicated above may be a solenoid valve of any known type or else also an electrically actuated valve of a different type, such as a valve with piezoelectric actuator. Also in the case of the solenoid valve, the valve may be of a normally closed type or else of a normally open type. In the latter case, obviously, what is important, for the purposes of the system according to the invention, is the control of the instant when the valve 60 sets up again the communication between the volume of pressurized fluid and the environment communicating with the fluid accumulator 80 irrespective of whether this is obtained by interrupting or activating a current supply.

According to a further characteristic that has already formed the subject of a previous patent application of the present applicant, not yet published at the date of filing of the present application, in the case where the control valve is a normally open solenoid valve, the electronic control unit can be programmed for supplying an electric tail current to the solenoid following upon de-energization thereof in order to brake the movement of the mobile member of the control valve before this reaches its end-of-travel position corresponding to the open condition of the communication between the volume of pressurized fluid and the environment communicating with the fluid accumulator.

What is claimed is:

1. A system for variable actuation of an engine valve of an internal-combustion engine, comprising:

a hydraulic apparatus including:

a master piston, a slave piston configured to be driven by said master piston by a volume of fluid set between said master piston and said slave piston, and a solenoid valve;

wherein said system further comprises:

a camshaft designed to drive said master piston in motion, which has a cam profile for governing, through said master piston, said engine valve in a four-stroke engine operating mode;

a control unit configured for controlling said solenoid valve so as to govern said engine valve, within said four-stroke engine operating mode, according to a lift and/or opening and closing times that are variable as a function of one or more parameters indicative of operating conditions of the engine;

wherein:

said camshaft or a further camshaft has a second cam profile for governing said valve in a two-stroke engine operating mode;

said hydraulic apparatus comprises:

a second master piston configured to be actuated by said second cam profile and that is designed to drive said slave piston by a second volume of fluid set between said second master piston and said slave piston;

a hydraulic circuit defining:

a first chamber mobile within which is said master piston;

a second chamber mobile within which is said second master piston; and a third chamber mobile within which is said slave piston;

said solenoid valve is configured for:

controlling communication of said first and second chambers with said third chamber and with said outlet;

assuming a first state where said first and second chambers are both in communication with said outlet so as to render said slave piston independent from movement of said first and second master pistons;

assuming a second state where i) said first chamber is in communication with said outlet so as to render said slave piston independent from movement of said first master piston, and ii) said second chamber is in communication with said third chamber; and assuming a third state where i) said first chamber is in communication with said third chamber, and ii) said second chamber is in communication with said outlet so as to render said slave piston independent from movement of said second master piston; and said control unit is configured for controlling said solenoid valve so as to govern said engine valve selectively in one or the other of the two-stroke engine operating mode and the four-stroke engine operating mode.

2. The system according to claim 1, wherein said control unit is configured for selecting the two-stroke or four stroke engine operating mode and is configured for governing said solenoid valve on the basis of the two-stroke or four stroke engine operating mode selected and on the basis of one or more parameters indicative of the operating conditions of the engine.

3. The system according to claim 1, wherein in said first state said third chamber is in communication with said outlet.

4. The system according to claim 1, wherein said outlet is connected to a fluid accumulator.

5. The system according to claim 1, wherein said control unit is configured for selecting the two-stroke or four-stroke engine operating mode on the basis of engine load.

6. The system according to claim 5, wherein said control unit is configured for comparing a reference value stored therein with a measured parameter indicative of the engine load.

7. A method for controlling a system for variable actuation of an engine valve of an internal-combustion engine, wherein said system comprises:

a hydraulic apparatus including:

a master piston actuated by a camshaft, said camshaft has a first cam profile for governing said engine valve in a four-stroke engine operating mode, and said camshaft or a further camshaft has a second cam profile for governing said engine valve in a two-stroke engine operating mode;

a slave piston configured to be driven by said master piston by a volume of fluid set between said master piston and said slave piston;

a second master piston configured to be actuated by said second cam profile and that is designed to drive said slave piston by a second volume of fluid set between said second master piston and said slave piston; and a solenoid valve configured for assuming:

a first state where said volume of fluid is set in communication with an outlet so as to render said slave piston independent from movement of said master piston;

a second state where said second volume of fluid is set in communication with the outlet so as to render said slave piston independent from movement of said second master piston; and a third state where both of said first and second volumes are set in communication with the outlet;

a control unit configured for controlling said solenoid valve so as to govern said engine valve according to a lift and/or opening and closing times that are variable as a function of one or more parameters indicative of operating conditions of the engine;

said method further comprising:

selecting one between the two-stroke engine operating mode and the four-stroke engine operating mode on the basis of the operating condition of engine load;

controlling said solenoid valve on the basis of the selected two-stroke or four-stroke engine operating mode so as to govern said engine valve in said selected two-stroke or four-stroke engine operating mode;

for at least one of the two-stroke and four-stroke engine operating modes, controlling said solenoid valve so as to govern said engine valve according to a lift and/or opening and closing times that are variable as a function of one or more parameters indicative of the operating conditions of the engine; and on the basis of the selected two-stroke or four-stroke operating mode, varying the state of said solenoid valve between said third state, said second state and said first state.

* * * * *